United States Patent [19]

Sweeney

[11] 4,357,992

[45] Nov. 9, 1982

[54] FLUID PRESSURIZATION APPARATUS AND TECHNIQUE

[75] Inventor: Gerald T. Sweeney, Puyallup, Wash.

[73] Assignee: Tigre Tierra, Inc., Puyallup, Wash.

[21] Appl. No.: 224,637

[22] Filed: Jan. 12, 1981

[51] Int. Cl.[3] ..... E21B 7/00; E21B 23/06; E21B 33/124; E21B 33/126

[52] U.S. Cl. ..... 166/250; 166/187; 166/191; 166/385; 166/387; 175/214

[58] Field of Search ..... 166/92, 93, 94, 97, 166/82, 75 R, 77, 385, 191, 187, 186, 387; 175/67, 212, 214, 21, 244

[56] References Cited

U.S. PATENT DOCUMENTS

| | | | |
|---|---|---|---|
| 992,527 | 5/1911 | Wigle | 175/210 X |
| 1,708,645 | 4/1929 | Wright | 166/93 X |
| 1,723,682 | 8/1929 | Deming | 166/191 UX |
| 1,901,031 | 3/1933 | Humason | 166/372 |
| 2,034,798 | 3/1936 | Clark | 166/263 |
| 2,057,425 | 10/1936 | Fletcher | 166/372 |
| 2,098,518 | 11/1937 | Pivoto | 175/214 |
| 2,176,323 | 10/1939 | Bowen et al. | 175/214 |
| 2,606,746 | 8/1952 | Ford | 175/214 |
| 3,039,533 | 6/1962 | Lacey | 166/187 X |
| 3,227,230 | 1/1966 | Lagerström | 175/214 |
| 3,303,897 | 2/1967 | Casper | 175/214 |
| 3,430,701 | 3/1969 | Canada | 166/186 X |
| 4,137,968 | 2/1979 | Howard et al. | 166/65 R |
| 4,279,304 | 7/1981 | Harper | 166/65 R X |

OTHER PUBLICATIONS

Weir Jones Engineering Consultants Ltd. Technical Service Bulletins 75-1 and 75-2.

The Piezofor—Continuous Membrane Borehole Piezometer, The Dectotofor—Inflatable Overpressure Gauge (France)

*Primary Examiner*—Stephen J. Novosad

*Attorney, Agent, or Firm*—Christopher Duffy

[57] ABSTRACT

The apparatus and technique are applicable to fluid pressurizing a portion of an elongated hole in the ground when a hollow tubular fluid transmission member is installed lengthwise therein. According to the technique, inflatable closure means are installed in the hole at a site adjacent the distal end portion of the member, and the closure means are inflated to form a fluid seal crosswise the hole at a longitudinal level therein spaced apart from the bottom of the hole. Fluid is charged into the member, and an opening is formed in the fluid seal whereby the fluid can discharge into the space between the level of the seal and the bottom of the hole to pressurize a portion of this space. In some embodiments, means are interposed between the member and the seal to deliver the fluid to the opening in the seal.

36 Claims, 5 Drawing Figures

78
90
86
86'
88
44
22
14'
80'
80
76
4'
45
54
82
30
74
2
50
42"
4
40
58"
14"
56
6
66
8
14
72
46
60'
62
38
60
12
28
70
60'
48
10
26
42'
24
58'
20
64
18
68
138
58
42
34
35
16

92
100
3
3
96
94
98
86'
101
101'
14'
44
4'
14
54
54
74
66
52
72
62
48'
10
70
64
32
68
138
42
36
34

FLUID PRESSURIZATION APPARATUS AND TECHNIQUE

THE INVENTION IN GENERAL

This invention relates to an apparatus and technique for fluid pressurizing a portion of an elongated hole in the ground when a hollow tubular fluid transmission member is installed lengthwise therein. The member may be installed in the hole solely for the purposes of the invention, that is, for the purposes of fluid pressurizing a portion of the hole; or the member may be installed in the hole for other purposes, such as for purposes of core sampling the bottom of the hole through the hollow bore of the member.

According to the inventive technique, inflatable closure means are installed in the hole at a site adjacent the distal end portion of the member, and the closure means are inflated to form a fluid seal crosswise the hole at a longitudinal level therein spaced apart from the bottom of the hole. Fluid is charged into the member, and an opening is formed in the fluid seal whereby the fluid can discharge into the space between the level of the seal and the bottom of the hole to pressurize a portion of this space.

In certain of the presently preferred embodiments of the invention, the opening is formed in the seal before the fluid is charged into the member. Also, in some embodiments, the opening is formed in the closure means before the closure means are inflated. In fact, in many embodiments, the opening is formed in the closure means before the closure means are installed in the hole.

The fluid is typically charged into the member after the closure means are inflated. In fact, the fluid is generally charged into the member after the closure means are installed and inflated in the hole and the opening is formed in the seal. In certain embodiments, the fluid is charged into the hollow bore of the member for transmission to the opening in the seal. In some embodiments, moreover, means are interposed between the member and the seal to deliver the fluid to the opening in the seal; and where the fluid is charged into the hollow bore of the member for transmission to the opening, the fluid delivery means are usually operative to interconnect the bore with the opening.

In many of the presently preferred embodiments, the closure means are installed in the hole after the member is installed therein; and in some embodiments, the closure means are installed at a site spaced apart from the distal end portion of the member. Also, in many embodiments, the seal is formed crosswise the hole at a longitudinal level therein spaced apart from the distal end portion of the member.

Moreover, in certain embodiments, the distal end portion of the member is spaced apart from the bottom of the hole to form a gap therebetween, and the seal is formed at a level in the gap. Also, the closure means are installed in the gap at a site spaced apart from the distal end portion of the member. The member may be installed in the hole so that the distal end portion thereof is spaced apart from the bottom of the hole to form the gap; or after its installation, say, for other purposes, the member may be retracted from the bottom of the hole to form the gap, such as following a core sampling operation.

In some of the presently preferred embodiments of the invention, the closure means are installed in the hole by inserting the same into the hollow bore of the tubular member after the member is installed in the hole. Also, in certain embodiments, the bore of the member is open ended, and the closure means are installed in the hole by inserting the same through the bore of the member into the hole. For example, where the distal end portion of the member is spaced apart from the bottom of the hole by a gap, the closure means may be installed in the gap by inserting the same through the distal end opening of the bore.

In certain embodiments, the closure means are installed in the hole by supporting the same on means installed in the hollow bore of the member. For example, where the hole is generally vertical, the closure means may be installed in the same by supporting them on means suspended in the hollow bore of the member.

In many embodiments, the closure means are installed in the hole by inserting the same through the hollow bore of the member on carrier means installed in the bore of the member. The carrier means are often supported at a point outside the bore of the member, and means are interposed between the carrier means and the member to locate the closure means at the aforesaid site in the hole. In some embodiments, the locating means are disposed on the carrier means, and the closure means are installed in the hole by inserting the carrier means in the bore of the member until the locating means engage the member at a point corresponding to the site for the closure means.

In many embodiments where the closure means are installed in the hole on carrier means which are inserted in the hollow bore of the member, the carrier means are accompanied by means which are interposed between the carrier means and the member to locate the carrier means at a point corresponding to the site for the closure means. Also, in many of these embodiments, the carrier means are adapted to terminate in spaced relationship to the proximal end of the bore when inserted in the same at the aforesaid point, and the fluid is charged into the space between the proximal end of the bore and the carrier means for transmission to the opening in the seal. In some embodiments, the carrier means are inserted in the bore on means which form a passage with the wall of the bore in the aforesaid fluid transmission space thereof, and the fluid is charged into the passage for transmission to the opening in the seal. Often the carrier means are adapted to form an extension of the passage with the wall of the bore when inserted at the aforesaid point, but an opening is formed in the carrier means to connect the passage with the opening in the seal, and a second fluid seal is formed crosswise the extension of the passage to cause the fluid to discharge through the interconnected openings in the carrier means and the first mentioned seal crosswise the hole. The second seal may be formed by inserting second inflatable closure means in the extension, and inflating the same to form a seal crosswise thereof. Typically, the carrier means are elongated and the respective first and second mentioned inflatable closure means are assembled about the respective distal and proximal end portions thereof.

Where the bore of the member is open ended at the distal end thereof and the distal end portion of the member is spaced apart from the bottom of the hole to form a gap therebetween, the first mentioned inflatable closure means are often inserted into the hole through the distal end opening of the bore and installed at a site in the gap. For example, the first mentioned inflatable closure means may be assembled about carrier means, the assembly may be inserted into the gap through the bore of the member, and a portion of the carrier means may be retained in the bore of the member to support the closure means in the gap. In some embodiments, the carrier means are supported at a point outside the bore of the member. For example, where the hole is generally vertical, the carrier means may be supported on a wireline device suspended from a point outside of the hole thereabove.

Once again, in these latter embodiments, the carrier means may terminate in spaced relationship to the proximal end of the bore, as described earlier, and may form an extension of the aforementioned passage; and in such a case, a second fluid seal may be formed in the extension to cause the fluid to discharge through the interconnected openings in the carrier means and the first mentioned seal crosswise the hole.

Where desired, the closure means may be inflated to form a pair of fluid seals crosswise the hole at longitudinal levels therein spaced apart from one another in the hole, and the interconnected openings in the carrier means and the first mentioned seal may be adapted to discharge the fluid into the space between the pair of seals to pressurize this space.

The invention lends itself to determining various conditions of the hole and/or the surrounding ground. For example, the invention may be used for insitu core pressure testing, or permeability testing of the surrounding ground. Additionally, the invention may be used for pressure grouting of fractured or unconsolidated formations in the surrounding ground, or for sealing an artesian flow in an open or cased bore hole. Alternatively, the invention may be used for hydraulic and pneumatic fracturing of a ground formation, or for the water infusion of a long-wall coal mine to control dust therein.

The testing can be done at the surface of the ground, such as by monitoring the fluid charged into the hollow tubular member, or by monitoring fluid pumped to the surface of the ground from the pressurized portion of the space between the level of the seal and the bottom of the hole. Alternatively, the testing can be done directly by pneumatically or electrically monitoring the fluid in the pressurized portion of the space using one or more sensors installed therein.

As indicated earlier, the invention also lends itself to a process wherein the hollow tubular member has other uses such as for core sampling, and one or more other members are removably installed in the same for these other purposes. According to the invention, the other member or members can be removed from the hollow tubular member, and the first mentioned inflatable closure means can be installed in the hole for the fluid pressurization operation. For example, the hollow tubular member may have another member such as an inner core barrel, installed in the hollow bore thereof, and the other member may be removed from the bore of the same before the inflatable closure means are installed in the hole through the bore.

One application of the invention involves drilling an elongated hole in the ground using a hollow, open ended drill rod, retracting the drill rod from the bottom of the hole to form a gap therebetween, and installing inflatable closure means in the gap through the hollow bore of the rod. The closure means are inflated to form the aforementioned seal, and an opening is formed in the seal whereby fluid charged into the bore of the rod can discharge as indicated.

Sometimes the inventive technique is employed during the process of core sampling the bottom of a hole by removing the samples through the hollow bore of an open ended drill rod used in forming the hole. In such a case, the inflatable closure means are often installed adjacent the distal end portion of the drill rod when the core sampling member is removed from the bore thereof, and are inflated to form the aforementioned seal with an opening in the same whereby fluid charged into the rod can discharge as indicated.

The inventive apparatus comprises inflatable closure means, means for installing the inflatable closure means in the hole at a site adjacent the distal end portion of the hollow tubular member, and means for inflating the closure means at this site. The closure means are adapted on inflation to form a fluid seal crosswise the hole at a longitudinal level therein spaced apart from the bottom of the hole, but there are fluid discharge means for forming an opening in the seal whereby fluid transmitted through the member can discharge into the space between the level of the seal and the bottom of the hole to pressurize a portion of this space.

As indicated, many embodiments of the apparatus further comprise fluid delivery means which are adapted to be interposed between the member and the seal to deliver the fluid to the opening in the seal. Where the fluid is charged into the bore of the member for transmission to the opening in the seal, the fluid delivery means are adapted to interconnect the bore with the opening.

In certain embodiments, the means for installing the inflatable closure means in the hole include means which are interconnected with the closure means and adapted to be inserted in the hollow bore of the member to support the closure means in the hole at the aforesaid site. In some embodiments, the support means are adapted to be supported in turn at a point outside the bore of the member; and in many embodiments, the apparatus further comprises means which are adapted to be interposed between the support means and the member to locate the closure means at the aforesaid site in the hole. The locating means are often disposed on the support means and adapted to engage the member at a point corresponding to the site for the closure means when the support means are inserted in the bore of the member.

The support means may include carrier means which are adapted to be inserted in the bore of the member and to terminate in spaced relationship to the proximal end of the bore when the closure means are installed at the aforesaid site. Also, consistent with the above, the apparatus may further comprise means adapted to be interposed between the carrier means and the member to locate the carrier means at a point in the bore of the member corresponding to the site for the closure means.

Typically, the support means also include carrier support means whereby the carrier means can be inserted in the bore of the member and supported from a point outside thereof. Also, in certain embodiments, the carrier support means are adapted to form a passage with the wall of the bore in the space between the proximal end of the bore and the carrier means, so that the fluid can be charged into the passage for transmission to the opening in the seal. In fact, in one set of embodiments, the carrier means are adapted to form an extension of the passage with the wall of the bore when the closure means are installed at the aforesaid site, but an opening is formed in the carrier means to connect the passage with the opening in the seal, and there are means adapted to be interposed in the extension of the passage to form a second fluid seal crosswise thereof to cause the fluid to discharge through the interconnected openings in the carrier means and the first mentioned seal crosswise the hole.

In many embodiments, the second seal forming means include second inflatable closure means adapted to be inserted in the extension of the passage, and means for inflating the second closure means in the extension to form a seal crosswise thereof. In certain embodiments, moreover, the carrier means are elongated and the respective first and second mentioned inflatable closure means are assembled about the respective distal and proximal end portions thereof. Also the means for inflating the first mentioned closure means are also operative to inflate the second mentioned closure means.

In some embodiments, the carrier support means take the form of a wireline device.

Furthermore, there are embodiments wherein the carrier means are elongated, the first mentioned inflatable closure means are assembled about the distal end portion thereof, and there are means on the proximal end portion of the carrier means to engage a peripherally transversely disposed stop in the bore of the member to locate the first mentioned closure means at a site spaced apart from the distal end of the member after the assembly comprising the first mentioned closure means and the distal end portion of the carrier means has been inserted through an opening in the distal end of the member from the bore thereof. In certain of these embodiments, the carrier means take the form of a hollow tubular fluid transmission element having a collar-like stationary head fixed thereon, and the respective inflatable closure means take the form of sleeve-like longitudinally flexible glands which are circumposed about the respective distal and proximal end portions of the element on opposite sides of the head, and are secured to the head in slidable engagement with the element to expand and contract lengthwise thereof when they are deflated and inflated, respectively.

In some embodiments, the proximal end portion of the element is equipped with a wireline-like device comprising a tubular sheath having leads extending therewithin, one of which leads is a cable interconnected with the element to enable the carrier means to be suspended thereon, and another of which leads is a pneumatic conduit for transporting the inflation fluid to one or more of the respective glands.

In one group of embodiments, the proximal and distal end portions of the element define openings for connecting the bore of the member with the space between the first mentioned seal and the bottom of the hole. Also, in some of these, the distal end portion of the element has a pair of sleeve-like longitudinally flexible glands similarly circumposed thereabout to expand and contract lengthwise thereof in spaced relationship to one another, and the opening in the distal end portion of the element is disposed in the space between the pair of glands thereon to enable the zone therebetween to be fluid pressurized.

In some instances, the apparatus may further comprise means for forming a cap on the proximal end portion of the hollow tubular member when the bore of the same is open ended and the closure means are installed at the aforesaid site in the hole. In some embodiments, the cap forming means are adapted to be engaged in the proximal end opening of the bore. Also, the cap forming means are adapted for the introduction of the fluid into the bore of the member therethrough; and in some instances, the cap forming means are adapted to have a wireline device passed therethrough into the bore of the member.

For an elongated drill rod having a hollow bore which is open ended at the proximal and distal ends thereof, the cap forming means often comprise means detachably connectible to the rod to form a fluid seal across the proximal end portion of the bore, and means whereby the fluid can be charged into the bore between the seal and the distal end opening of the bore when the seal forming means are connected to the rod. The fluid charging means may be actuated and deactuated by attachment and detachment of the seal forming means to and from the rod, respectively. For example, the seal forming means may have the fluid charging means thereon for attachment and detachment to and from the rod therewith. In some embodiments, the seal forming means take the form of a cap for the proximal end portion of the rod, and the fluid charging means take the form of a nipple on the cap.

Often, the cap forming means further comprise means on the seal forming means whereby other apparatus such as the inventive inflatable closure means can be supported in the bore of the rod from a point adjacent the seal when the seal is formed across the proximal end portion of the bore. For example, the seal forming means may have means thereon whereby a wireline device can be suspended in the bore from a point adjacent the seal to support the other apparatus in the bore. In certain embodiments, the seal forming means have an aperture therein whereby the wireline device can be passed therethrough in a fluid tight manner. In fact, the seal forming means may be mounted on a wireline device; and in some embodiments the wireline device may comprise a tubular sheath having a plurality of leads extending therewithin, including a cable for supporting other apparatus in the bore of the rod, and possibly a pneumatic conduit for transporting an inflation fluid to the other apparatus.

In addition to many of the foregoing features, the fluid pressurization apparatus often further comprises a pump for pumping pressurized fluid to the surface of the ground from the space between the seal and the bottom of the hole; and/or a sensor for monitoring the pressurized fluid in the space between the seal and the bottom of the hole.

Sometimes the apparatus is combined with a hollow, open ended drill rod for drilling the hole. In such a case, the distal end of the rod may have an annular bit thereon, and the inflatable closure means may be adapted to be installed in the hole through the hollow bore of the rod. Also, there may be means for supporting the inflatable closure means in the hole at a site spaced apart from the distal end portion of the rod.

Also, the fluid pressurization apparatus is sometimes combined with core drilling apparatus that includes an enlogated hollow, open ended drill rod, the distal end portion of which include a core barrel having an annular bit at the distal end thereof. In such a case, the inflatable closure means may be adapted for installation at a site adjacent the distal end portion of the rod when the hollow bore of the rod is open to the distal end opening thereof in the bit so that the fluid can discharge as indicated when transmitted through the rod.

BRIEF DESCRIPTION OF THE DRAWINGS

These features will be better understood by reference to the accompanying drawings wherein several embodiments of the inventive fluid pressurization apparatus and technique are illustrated in connection with a conventional core drilling operation using a conventional two barrel core drilling apparatus, the inner barrel of which has been removed for purposes of executing the present invention in the hole drilled by the drilling apparatus.

In the drawings.

DESCRIPTION OF THE PREFERRED EMBODIMENTS

Figure 1:
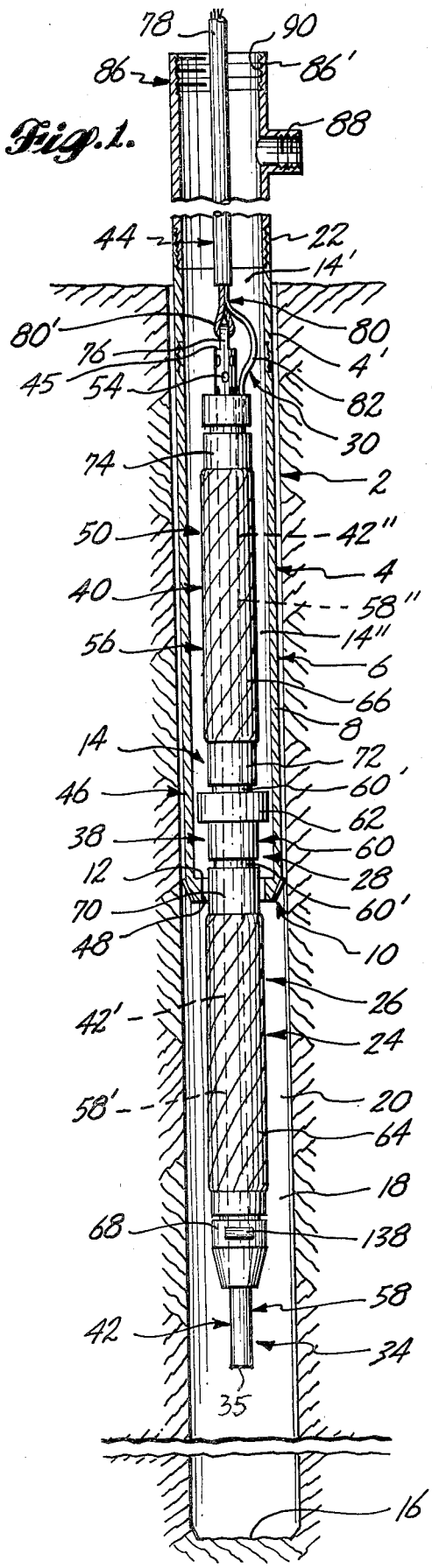
FIG. 1 is a part cross-sectional view of one embodiment of the fluid pressurization apparatus being inserted in the core drilling apparatus.
Figure 2:
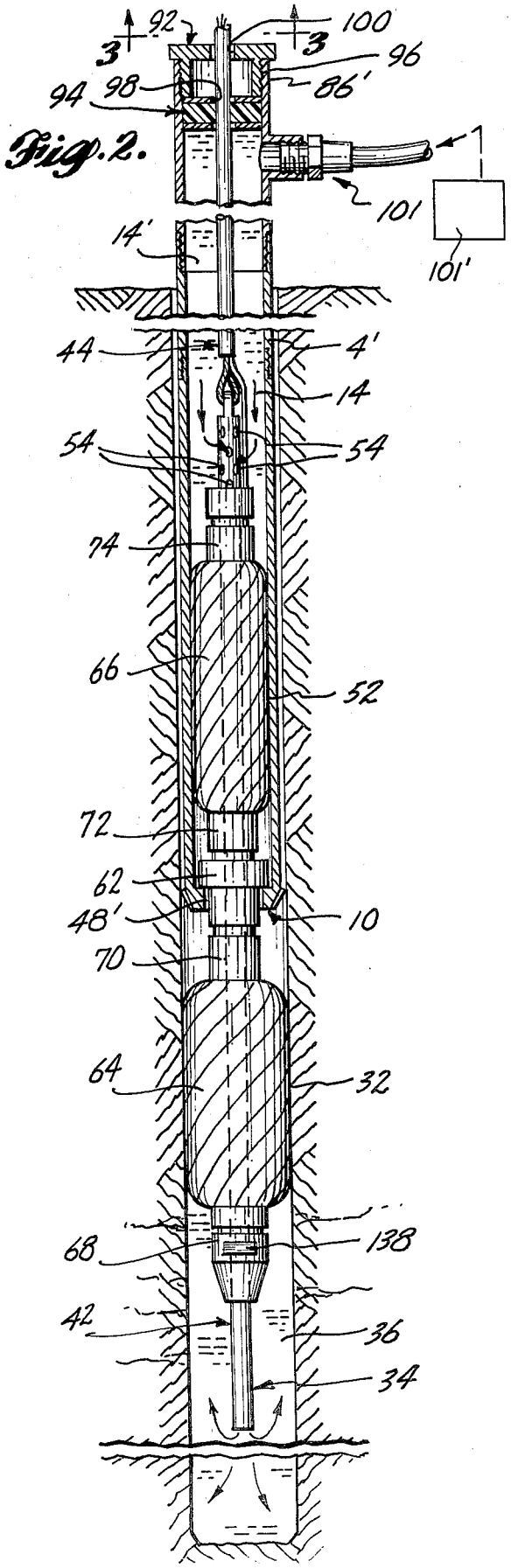
FIG. 2 is a similar view when the fluid pressurization apparatus is installed and in use.

Referring initially to FIGS. 1 and 2 in the drawings, it will be seen that the core drilling apparatus 2 comprises an elongated hollow, open ended drill rod 4, the distal end portion 6 of which includes a core barrel 8 having an annular bit 10 at the distal end thereof. The core barrel 8 is integrated in the rod 4 by threading it onto the last section 4' thereof, and the bit 10 has an annular shoulder 12 around the inside thereof, which is disposed crosswise the hollow, open ended bore 14 of the rod. During the core drilling operation, a smaller sized barrel is inserted in the bore and engaged with the shoulder to receive the core sample. However, neither this smaller inner barrel nor the sample is shown, inasmuch as the inner barrel is withdrawn from the rod in preparing for the fluid pressurization operation, as shall be explained. Moreover, at this same time, the rod itself is retracted from the bottom 16 of the hole 18 to form a gap 20 between the bit 10 and the bottom of the hole; and the proximal or top end 22 of the rod is capped to enable a fluid pressurization medium to be charged through the bore 14 during the fluid pressurization operation.

The fluid pressurization apparatus 24 comprises inflatable closure means 26, means 28 for installing the inflatable closure means 26 in the hole 18 at a site adjacent the distal end portion 6 of the rod, and means 30 for inflating the closure means 26 at this site. The closure means 26 are adapted on inflation to form a fluid seal 32 crosswise the hole at a longitudinal level therein spaced apart from the bottom 16 of the hole, but there are fluid discharge means 34 forming an opening 35 in the seal whereby fluid transmitted through the rod can discharge into the space 36 between the level of the seal and the bottom of the hole to pressurize a portion of this space.

The apparatus further comprises fluid delivery means 40 which are adapted to be interposed between the rod 4 and the seal 32 to deliver the fluid to the opening 35 in the seal.

The means 28 for installing the inflatable closure means in the hole include support means 38 which are interconnected with the closure means 26 and adapted to be inserted in the bore 14 of the rod to support the closure means in the hole at the aforesaid site, and more specifically, to suspend the closure means in the hole at this site, inasmuch as the hole is generally vertically oriented in the ground. The support means 38 include carrier means 42 which are adapted to be inserted in the bore at the distal end portion 6 of the rod and to terminate in spaced relationship to the proximal end 22 of the bore when the closure means 26 are installed at the aforesaid site. The support means also include carrier support means in the form of an umbilical-cord-like wireline device 44 whereby the carrier means 42 can be inserted in the bore of the rod and supported in the distal end portion thereof from a point outside the bore. The wireline device 44 is adapted to form a passage 14' with the wall of the bore in the space between the proximal end 22 of the bore and the proximal or terminal end 45 of the carrier means, so that the fluid can be charged into the passage 14' for transmission to the opening 35 in the seal 32 crosswise the hole.

The apparatus 24 further comprises stop means 46 which are interposed between the support means 38 and the rod to locate the closure means 26 at the aforesaid site in the hole. In some instances, the stop means may also operate to transfer support of the closure means at least in part to the rod.

The carrier means 42 are adapted to form an extension 14'' of the passage 14' with the wall of the bore; but an opening 54 is formed in the carrier means 42 to connect the passage with the opening 35 in the seal 32, and the fluid delivery means 40 include means 50 which are interposed in the extension 14'' to form a second fluid seal 52 crosswise thereof to cause the fluid to discharge through the interconnected openings 54 and 35 in the carrier means and the first mentioned seal 32 crosswise the hole. The second seal forming means 50 include second inflatable closure means 56 which are inserted in the extension and inflatable to form the seal 52 crosswise thereof.

The carrier means 42 are elongated and the respective first and second mentioned inflatable closure means 26 and 56 are assembled about the respective distal and proximal end portions 42' and 42'' thereof. The same or additional means 30 are used to inflate the second inflatable closure means 56.

The assembly comprising the inflatable closure means 26 and the distal end portion 42' of the carrier means is adapted to be inserted into the gap 20 of the hole through the opening 48 in the bit 10 at the distal end of the rod. Moreover, the stop means 46 are adapted to engage a peripherally transversely disposed stop in the bore of the rod, such as the shoulder 12 of the bit, to locate the closure means in the gap at a site spaced apart from both the distal end of the rod and the bottom of the hole.

More specifically, the carrier means 42 take the form of a hollow tubular fluid transmission element 58 having a collar-like stationary head 60 fixed thereon. The stop means and/or support transfer means 46 take the form of a peripheral flange 62 on the head. Normally, both the head 60 and the flange 62 are cylindrical to correspond to the typical bore of a drill rod. The respective inflatable closure means 26 and 56 take the form of sleeve-like longitudinally flexible steel reinforced rubber glands 64 and 66, respectively, which are circumposed about the respective distal and proximal end portions 58' and 58'' of the element on opposite sides of the head, and equipped with ferrule-like collars 68, 70 and 72, 74, respectively, on the opposing ends thereof, the relatively adjacent of which, 70 and 72, are secured to the opposing ends 60′ of the head, and the relatively remote of which, 68 and 74, are slidably engaged on the element to enable the respective glands to expand and contract lengthwise thereof when they are deflated and inflated, respectively.

Figure 3:
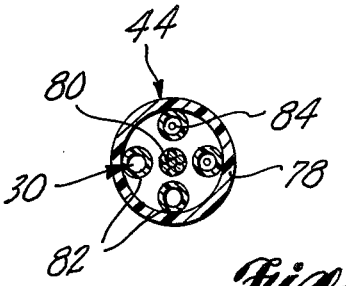
FIG. 3 is a cross-section of the wireline device by which the fluid pressurization apparatus is suspended in the core drilling apparatus.

The proximal end portion 58″ of the element is equipped with an eye 76 and the wireline-like device 44 comprises a tubular plastic sheath 78 having several leads 80, 82 and 84 (FIG. 3) extending therewithin, one of which, 80, is a stranded-steel, end-eyed cable, the eye 80′ of which is interconnected with the eye 76 on the element, to enable the carrier means to be suspended on the cable 80. The remaining leads 82 and 84 include at least one pneumatic conduit 82 for transporting the inflation fluid to the respective glands, and if desired, one or more electrical leads 84 for use in making various determinations relative to conditions in the fluid pressurized portion of the space 36 and/or the surrounding ground. The conduit 82 extends beyond the device 44 to the glands, and has sufficient slack for the operational movement of the glands. Where used, the leads 84 extend within or without the element 58, and may also require slack.

The respective proximal and distal end portions 58″ and 58′ of the hollow tubular element 58 define the interconnected openings 54 and 35 to the passage 14′ and the seal 32. Normally more than one opening 54 is employed in the proximal end portion 58″ of the element to maximize the inflow of fluid into the element from the passage 14′. Also, both end portions 58′ and 58″ of the element are normally partially uncovered by the respective glands 64 and 66 when the glands are in their deflated condition.

The proximal end portion 22 of the drill rod 4 is normally capped by a two part assembly which includes a nippled, hollow tubular fitting 86, the nipple 88 of which is spaced below the upper end 86′ of the same to project to one side thereof. The fitting 86 is threaded onto the proximal end 22 of the rod and has female threads 90 inside the upper end thereof to receive a plug-like cap 92 having an elastomeric seal 94 on the inside end thereof. The seal comprises a three layer elastomeric sandwich and is sized to fit closely within the upper end portion 86′ of the fitting above the nipple, but below the threads 90 on the same, so that male threading 96 on the cap can be used to secure it within the fitting. In addition, the seal 94 and cap 92 are apertured at 98 and 100, respectively, to enable the wireline device 44 to be passed through the assembly in a fluid-tight manner. A male hose fitting 101 is threadedly connected to the nipple and external pressurization means 101′ are connected with the same for purposes of charging the fluid into the bore 14 of the rod.

Operationally, the hole 18 is drilled in stages by the apparatus 2, and during each stage the rod 4 is equipped with a removable inner barrel as explained earlier, for collecting core samples of the ground material through the distal end opening 48 of the rod. However, on the completion of each core drilling run, the inner barrel is retracted from the rod in conventional fashion, and the fitting 86 is threaded onto the top 22 of the rod in preparation for a fluid pressurization run, such as one done to test the permeability of the surrounding ground at the bottom of the hole. Also, the rod is retracted from the bottom of the hole to form the gap 20, and the apparatus 24 is lowered into the bore of the rod in the manner of FIG. 1, using the wireline device 44 as a suspension means for the same.

When the apparatus 24 reaches the distal end portion 6 of the rod, the deflated assembly 26, 34 passes through the end opening 48 of the same until the stop means 46 encounter the shoulder 12 of the bit. At this point, the inflatable closure means 26 take up a position in the gap 20 spaced apart from both the bottom 16 of the hole and the distal end 10 of the rod. However, the carrier means 42 terminate in the bore of the rod and, as indicated, form an extension 14‴ of the annular passage 14′ which surrounds the wireline device 44 thereabove. The carrier means also form an annular clearance 48′ with the mouth of the opening 48 in the rod, due to the size of the opening needed to pass the assembly. Therefore, at this stage, both ends of the bore are open ended.

However, before the apparatus 24 is lowered into the bore, the cap 92 is engaged about the wireline device; and once the apparatus is in position at the site for the closure means 26, the cap is applied to the fitting 86 in the manner of FIG. 2, and the seal 52 is formed across the extension 14″ by inflating the closure means 56 on the proximal end portion of the carrier means. The closure means 26 may also be inflated at this time to form the seal 32 crosswise the hole itself. In any event, when the cap 92 and the respective seals 52 and 32 are in place, the hose fitting 101 is secured to the nipple 88 of the cap fitting 86 and depending on the purpose of the operation, water or some other pressurization fluid is charged into the bore of the rod for transmission to the apparatus 24 through the passage 14 surrounding the wireline device. Downstream of the bore, as the fluid encounters the seal 52, it is delivered to the openings 54 in the seal 52 and transmitted through the hollow bore of the carrier means to the opening 35. At the opening 35, the fluid discharges into the space 36 and the fluid pressurizes the space for the purposes of the operation.

When the pressurization operation is completed, the inflation pressure in the glands 64 and 66 is relieved at the surface of the ground, the cap 92 is released and/or removed, and the apparatus 24 is raised to the surface through the bore of the rod using the wireline device 44, thus freeing the bore for resumption of the core sampling operation as the apparatus 2 is used to extend the hole.

Figure 4:
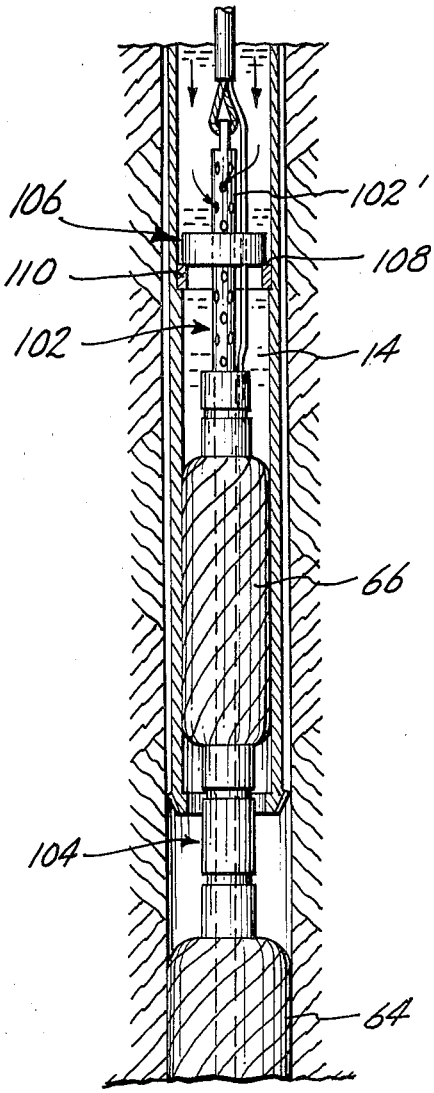
FIG. 4 is a view similar to FIG. 2, but of a second embodiment of the fluidization apparatus.

In FIGS. 1 and 2, the stationary head 60 is disposed centrally of the carrier element 58 between the glands 64 and 66, and the flange 62 is disposed on the same as indicated. In FIG. 4, the carrier element 102 is equipped with a stationary head 104 at the center thereof for the collars 70 and 72 of the respective glands; but the head 104 has no flange, and in lieu of the same, the element is equipped with an additional stationary head 106 that is disposed on the proximal end portion 102′ of the element and oversized in full to serve as the flange. Also, the latter head 106 is disposed between the gland 66 and the proximal end 102′ of the element to engage an annular shoulder 108 on the wall of the bore 14, which is spaced well above the bit 10, rather than at a location contiguous to it, as was the shoulder 12 in FIGS. 1 and 2.

The flanges 62 and 106 may be sized to slidably insert within the bore of the rod; or if needed, an annular bridging element 110 can be interposed between the respective flanges and the corresponding shoulder 12 or 108, to assure that the apparatus 24 engages the rod for the proper location of the gland 64, or the glands 64 and 66, as explained. In fact, by using a set of bridging elements and a flange of certain minimal size, it is possible to standardize the apparatus with respect to the sizing of the flange.

Preferably, the distal end collar 68 on the gland 64 is tapered as shown, to facilitate passage of the assembly 26, 34 through the distal end opening 48 of the rod.

Figure 5:
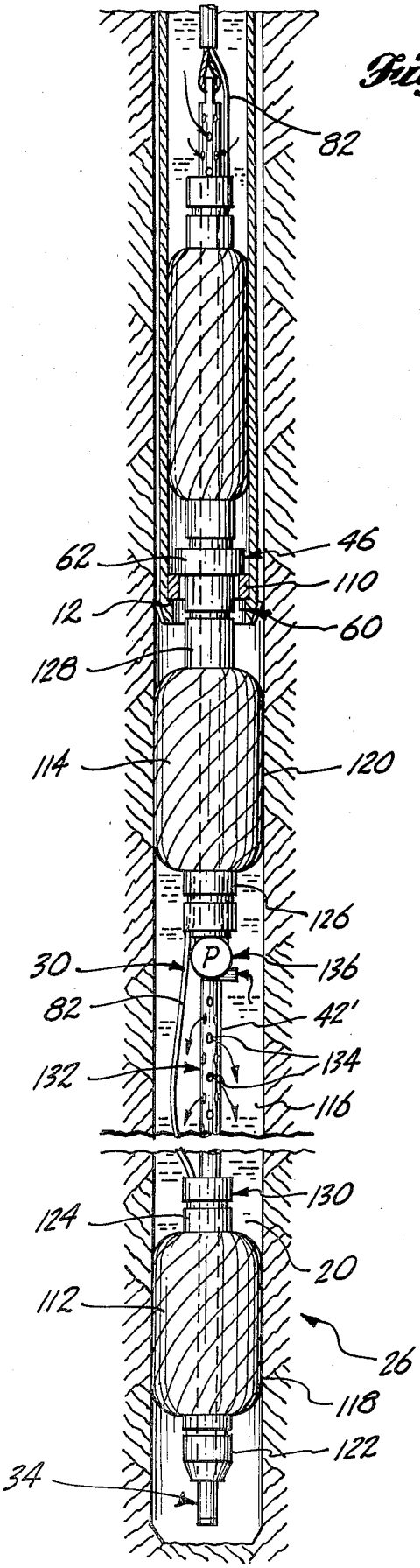
FIG. 5 is the same but of a third embodiment.

In FIG. 5 the inflatable closure means 26 comprise a pair of inflatable closure members such as the glands 112 and 114. The glands are assembled about the distal end portion 42' of the carrier means in spaced relationship to one another, and the stop means 46 are spaced apart from the relatively proximal member 114 to locate the pair of members in the gap 20 at the aforesaid site for the same when the stop means are engaged on the shoulder 12. Moreover, the carrier means 42 are capped at the distal end 34 thereof and are centrally apertured so that the fluid entering the same from the bore 14 of the rod can discharge at an opening 134 in the space 116 between the respective members 112 and 114, to pressurize that portion 116 of the gap 20 lying between the seals 118 and 120 formed by the respective members when they are inflated. As in FIGS. 1 and 2, the glands have ferrule-like collars 122, 124, 126 and 128 on the opposing ends thereof, and one collar, 124 or 128, of each gland is secured to the adjacent end of a stationary head 130 or 60, and the other collar, 122 or 126, is slidably engaged on the element 132 of the carrier means to enable the respective gland to expand and contract lengthwise thereof when it is inflated and deflated. Normally separate conduits 82 are provided for inflating the glands, so that the proximal gland 114 can be used to seal off the space between the bottom of the hole and the seal 120 thereof when desired, in lieu of isolating the zone 116 between the glands. Also, normally more than one opening 134 is employed in the element 132 between the glands, to maximize the outflow of fluid through the same.

The operation is similar to that described in connection with FIGS. 1 and 2. However, in this instance the zone 116 between the seals 118 and 120 is pressurized. Alternatively, the zone between the seal 120 and the bottom of the hole may be isolated and pressurized instead.

Where the pressurization operation has the purpose of monitoring conditions in the pressurized zone, the conditions may be monitored by instruments at the surface of the ground or by instruments on the apparatus 24 at the locus of the zone. In addition, the conditions may be monitored at the surface by instruments which monitor the pressurization medium as it is charged into the bore of the rod, or by instruments which monitor the pressurization medium as it is pumped from the pressurized zone. Referring again to FIG. 5, it will be seen that the collar 126 has an electrically driven pump 136 thereon, to intake pressurized fluid medium from the zone 116 and to pump the medium to the surface of the ground through an additional conduit 82 in the sheath of the wireline device 44. The pump is powered through a lead 84 in the sheath.

FIGS. 1 and 2 illustrate an apparatus and technique for monitoring conditions at the pressurized zone itself. The collar 68 has a sensor 138 thereon, to feed electrical readings to the surface of the ground through one or more electrical leads 84 in the device 44. Alternatively, the sensor may transmit the readings pneumatically or hydraulically through one or more conduits 82 in the sheath of the wireline device.

The closure means 26 may be increased to any number of glands, to isolate any number of zones; and in addition, the glands may be separately operated to combine zones or to isolate zones in any desired sequence. Moreover, sensors 138 can be employed at numerous locations on the apparatus 24 to monitor conditions both inside and outside of the test zone or zones down the hole.

Numerous media can be passed through the carrier means, depending on the purposes of the pressurization operation, and in certain instances, the size of the openings 54 and 35, or 134 in the carrier means.

The bridging elements 108 and 110 are commonly landing rings of the type made by E. J. Longyear Company of Minneapolis, Minnesota.

What is claimed is:

1. A method of fluid pressurizing a portion of the wall of a hole in the ground, comprising installing lengthwise in the hole in spaced relationship to the bottom thereof, an elongated rod having a hollow bore therethrough which is open ended at the proximal and distal ends thereof, inserting a plurality of inflatable closure members into the bore of the rod in tandem array through the proximal end opening thereof, and then inserting the relatively forward of said members into the hole through the distal end opening of the rod and positioning the same in the space between the rod and the bottom of the hole so as to leave a gap between one of said members and the bottom of the hole, inflating the respective closure members to form first and second fluid seals across the bore of the rod and that portion of the hole in the space between the rod and the bottom of the hole, respectively, forming a third fluid seal across the proximal end portion of the bore in spaced relationship to the first fluid seal therein, forming a fluid connection between the portion of the bore in the space between the first and third fluid seals and a portion of the hole lying in the gap between the second fluid seal and the bottom of the hole, filling the interconnected portions of the bore and the hole with a fluid charge, applying pressure to the charge by means external thereof while exposing the wall of the hole in the gap to the fluid thereof, and monitoring conditions in the charge to determine the character of the ground surrounding the aforesaid portion of the hole in the gap.

2. The method according to claim 1 wherein conditions in the charge are monitored at the point at which the fluid is introduced to the bore of the rod.

3. A method of fluid pressurizing a portion of the wall of a hole in the ground, comprising installing lengthwise in the hole in spaced relationship to the bottom thereof, an elongated rod having a hollow bore therethrough which is open ended at the proximal and distal ends thereof, inserting a plurality of inflatable closure members into the bore of the rod in tandem array through the proximal end opening thereof, and then inserting the relatively forward of said members into the hole through the distal end opening of the rod and positioning the same in the space between the rod and the bottom of the hole so as to leave a gap between one of said members and the bottom of the hole, inflating the respective closure members to form first and second fluid seals across the bore of the rod and that portion of the hole in the space between the rod and the bottom of the hole, respectively, forming a third fluid seal across the proximal end portion of the bore in spaced relationship to the first fluid seal therein, forming a fluid connection between the portion of the bore in the space between the first and third fluid seals and a portion of the hole lying in the gap between the second fluid seal and the bottom of the hole, filling the interconnected portions of the bore and the hole with a fluid charge, applying pressure to the charge by means external thereof while exposing the wall of the hole in the gap to the fluid thereof, and monitoring conditions in the charge at a point in that portion of the hole lying in the gap between the second fluid seal and the bottom of the hole.

4. A method of fluid pressurizing a portion of the wall of a hole in the ground, comprising installing lengthwise in the hole in spaced relationship to the bottom thereof, an elongated rod having a hollow bore therethrough which is open ended at the proximal and distal ends thereof, inserting a plurality of inflatable closure members into the bore of the rod in tandem array through the proximal end opening thereof, and then inserting the relatively forward of said members into the hole through the distal end opening of the rod and positioning the same in the space between the rod and the bottom of the hole so as to leave a gap between one of said members and the bottom of the hole, inflating the respective closure members to form first and second fluid seals across the bore of the rod and that portion of the hole in the space between the rod and the bottom of the hole, respectively, forming a third fluid seal across the proximal end portion of the bore in spaced relationship to the first fluid seal therein, forming a fluid connection between the portion of the bore in the space between the first and third fluid seals and a portion of the hole lying in the gap between the second fluid seal and the bottom of the hole, filling the interconnected portions of the hole and the hole with a fluid charge, applying pressure to the charge by means external thereof while exposing the wall of the hole in the gap to the fluid thereof, and monitoring conditions in the charge by sampling the same at a point in that portion of the hole in the gap between the second fluid seal and the bottom of the hole, and transferring the sample to a point at the surface of the ground.

5. A method of fluid pressurizing a portion of the wall of a hole in the ground, comprising installing lengthwise in the hole in spaced relationship to the bottom thereof, an elongated rod having a hollow bore therethrough which is open ended at the proximal and distal ends thereof, inserting a plurality of inflatable closure members into the bore of the rod in tandem array through the proximal end opening thereof, and then inserting the relatively forward of said members into the hole through the distal end opening of the rod and positioning the same in the space between the rod and the bottom of the hole so as to leave a gap between one of said members and the bottom of the hole, inflating the respective closure members to form first and second fluid seals across the bore of the rod and that portion of the hole in the space between the rod and the bottom of the hole, respectively, forming a third fluid seal across the proximal end portion of the bore in spaced relationship to the first fluid seal therein, forming a fluid connection between the portion of the bore in the space between the first and third fluid seals and a portion of the hole lying in the gap between the second fluid seal and the bottom of the hole, filling the interconnected portions of the bore and the hole with a fluid charge, and applying pressure to the charge by means external thereof while exposing the wall of the hole in the gap to the fluid thereof, the distal end opening of the rod being defined by an annular bit and the rod being installed in the hole by excavating the same with the rod in a drilling operation.

6. A method of fluid pressurizing a portion of the wall of a hole in the ground, comprising installing lengthwise in the hole in spaced relationship to the bottom thereof, an elongated rod having a hollow bore therethrough which is open ended at the proximal and distal ends thereof, inserting a plurality of inflatable closure members into the bore of the rod in tandem array through the proximal end opening thereof, and then inserting the relatively forward of said members into the hole through the distal end opening of the rod and positioning the same in the space between the rod and the bottom of the hole so as to leave a gap between one of said members and the bottom of the hole, inflating the respective closure members to form first and second fluid seals across the bore of the rod and that portion of the hole in the space between the rod and the bottom of the hole, respectively, forming a third fluid seal across the proximal end portion of the bore in spaced relationship to the first fluid seal therein, forming a fluid connection between the portion of the bore in the space between the first and third fluid seals and a portion of the hole lying in the gap between the second fluid seal and the bottom of the hole, filling the interconnected portions of the bore and the hole with a fluid charge, and applying pressure to the charge by means external thereof while exposing the wall of the hole in the gap to the fluid thereof, the hole being relatively downwardly inclined to the surface of the ground and the inflatable closure members being inserted into the bore of the rod by lowering a tandem array of the same into the bore on a wireline device.

7. The method according to claim 6 wherein the wire-line device has a closure device thereon and the closure device is engaged with the proximal end portion of the rod to form the third fluid seal across the proximal end portion of the bore therein.

8. The method according to claim 7 wherein the closure device is adapted to form the third fluid seal in spaced relationship to the proximal end of the rod, and the interconnected portions of the bore and the hole are filled with the fluid charge by introducing the same through an inlet on the closure device in the space between the third fluid seal and the proximal end of the rod.

9. A method of fluid pressurizing a portion of the wall of a hole in the ground, comprising installing lengthwise in the hole in spaced relationship to the bottom thereof, an elongated rod having a hollow bore therethrough which is open ended at the proximal and distal ends thereof, inserting a plurality of inflatable closure members into the bore of the rod in tandem array through the proximal end opening thereof, and then inserting the relatively forward of said members into the hole through the distal end opening of the rod and positioning the same in the space between the rod and the bottom of the hole so as to leave a gap between one of said members and the bottom of the hole, inflating the respective closure members to form first and second fluid seals across the bore of the rod and that portion of the hole in the space between the rod and the bottom of the hole, respectively, forming a third fluid seal across the proximal end portion of the bore in spaced relationship to the first fluid seal therein, forming a fluid connection between the portion of the bore in the space between the first and third fluid seals and a portion of the hole lying in the gap between the second fluid seal and the bottom of the hole, filling the interconnected portions of the bore and the hole with a fluid charge, and applying pressure to the charge by means external thereof while exposing the wall of the hole in the gap to the fluid thereof, the array of inflatable closure members including three such members, the relatively forward two of which are inserted into the hole through the distal end opening of the rod and positioned and inflated in the space between the rod and the bottom of the hole so as to form the second fluid seal and a fourth fluid seal spaced apart therefrom so as to isolate a fraction of the space.

10. Apparatus for fluid pressurizing a portion of the wall of a hole in the ground having an elongated rod installed lengthwise therein in spaced relationship to the bottom thereof, said rod having a hollow bore therethrough which is open ended at the proximal and distal ends thereof, comprising means defining a plurality of inflatable closure members which are tandemly insertable in the bore of the rod through the proximal end opening thereof and the relatively forward of which is or are then insertable into the hole through the distal end opening of the rod for positioning in the space between the rod and the bottom of the hole at a point adapted to leave a gap between one of said members and the bottom of the hole, means for inflating the respective members to form first and second fluid seals across the bore of the rod and that portion of the hole in the space between the rod and the bottom of the hole, respectively, means for forming a third fluid seal across the proximal end portion of the bore in spaced relationship to the first fluid seal therein, means operative to form a fluid connection between the portion of the bore in the space between the first and third fluid seals and a portion of the hole lying in the gap between the second fluid seal and the bottom of the hole, means for filling the interconnected portions of the bore and the hole with a fluid charge, means external of the charge for applying pressure to the same while the wall of the hole in the gap is exposed to the fluid of the charge, and means for monitoring conditions in the charge to determine the character of the ground surrounding the aforesaid portion of the hole in the gap.

11. Apparatus for fluid pressurizing a portion of the wall of a hole in the ground having an elongated rod installed lengthwise therein in spaced relationship to the bottom thereof, said rod having a hollow bore therethrough which is open ended at the proximal and distal ends thereof, comprising means defining a plurality of inflatable closure members which are tandemly insertable in the bore of the rod through the proximal end opening thereof and the relatively forward of which is or are then insertable into the hole through the distal end opening of the rod for positioning in the space between the rod and the bottom of the hole at a point adapted to leave a gap between one of said members and the bottom of the hole, means for inflating the respective members to form first and second fluid seals across the bore of the rod and that portion of the hole in the space between the rod and the bottom of the hole, respectively, means for forming a third fluid seal across the proximal end portion of the bore in spaced relationship to the first fluid seal therein, means operative to form a fluid connection between the portion of the bore in the space between the first and third fluid seals and a portion of the hole lying in the gap between the second fluid seal and the bottom of the hole, means for filling the interconnected portions of the bore and the hole with a fluid charge, and means external of the charge for applying pressure to the same while the wall of the hole in the gap is exposed to the fluid of the charge, the distal end opening of the rod being defined by an annular bit.

12. Apparatus for fluid pressurizing a portion of the wall of a hole in the ground having an elongated rod installed lengthwise therein in spaced relationship to the bottom thereof, said rod having a hollow bore therethrough which is open ended at the proximal and distal ends thereof, comprising means defining a plurality of inflatable closure members which are tandemly insertable in the bore of the rod through the proximal end opening thereof and the relatively forward of which is or are then insertable into the hole through the distal end opening of the rod for positioning in the space between the rod and the bottom of the hole at a point adapted to leave a gap between one of said members and the bottom of the hole, means for inflating the respective members to form first and second fluid seals across the bore of the rod and that portion of the hole in the space between the rod and the bottom of the hole, respectively, means for forming a third fluid seal across the proximal end portion of the bore in spaced relationship to the first fluid seal therein, means operative to form a fluid connection between the portion of the bore in the space between the first and third fluid seals and a portion of the hole lying in the gap between the second fluid seal and the bottom of the hole, means for filling the interconnected portions of the bore and the hole with a fluid charge, and means external of the charge for applying pressure to the same while the wall of the hole in the gap is exposed to the fluid of the charge, the inflatable closure members being assembled in a tandemly spaced array of the same and suspended on a wireline device for lowering into the bore of the rod when the hole is relatively downwardly inclined to the surface of the ground, and the means for forming the third fluid seal including a closure device on the wireline device which is engagable with the proximal end portion of the rod to form the third fluid seal across the proximal end portion of the bore therein.

13. The apparatus according to claim 12 wherein the closure device is engagable with the proximal end portion of the rod to form the third fluid seal in spaced relationship to the proximal end of the rod, and there is an inlet on the closure device in the space between the third fluid seal and the proximal end of the rod through which the fluid can be introduced to that portion of the bore in the space between the first and third fluid seals.

14. Apparatus for fluid pressurizing a portion of the wall of a hole in the ground having an elongated rod installed lengthwise therein in spaced relationship to the bottom thereof, said rod having a hollow bore therethrough which is open ended at the proximal and distal ends thereof, comprising means defining a plurality of inflatable closure members which are tandemly insertable in the bore of the rod through the proximal end opening thereof and the relatively forward of which is or are then insertable into the hole through the distal end opening of the rod for positioning in the space between the rod and the bottom of the hole at a point adapted to leave a gap between one of said members and the bottom of the hole, means for inflating the respective members to form first and second fluid seals across the bore of the rod and that portion of the hole in the space between the rod and the bottom of the hole, respectively, means for forming a third fluid seal across the proximal end portion of the bore in spaced relationship to the first fluid seal therein, means operative to form a fluid connection between the portion of the bore in the space between the first and third fluid seals and a portion of the hole lying in the gap between the second fluid seal and the bottom of the hole, means for filling the interconnected portion of the bore and the hole with a fluid charge, and means external of the charge for applying pressure to the same while the wall of the hole in the gap is exposed to the fluid of the charge, there being three inflatable closure members, the relatively forward two of which are interconnected in tandem array and insertable into the hole through the distal end opening of the rod for positioning in the space between the rod and the bottom of the hole, and the two relatively forward members being adapted to form the second fluid seal and a fourth fluid seal which is spaced apart from the same so as to isolate a fraction of the space.

15. Apparatus for fluid pressurizing a portion of the wall of a hole in the ground, comprising an elongated rod adapted to be installed lengthwise in the hole in spaced relationship to the bottom thereof and having a hollow bore therethrough which is open ended at the proximal and distal ends thereof, means defining a plurality of inflatable closure members which are tandemly insertable into the bore of the rod through the proximal end opening thereof and the relatively forward of which is or are adapted to be inserted then into the hole through the distal end opening of the rod for positioning in the space between the rod and the bottom of the hole at a point adapted to leave a gap between one of said members and the bottom of the hole, means for inflating the respective closure members to form first and second fluid seals across the bore of the rod and that portion of the hole in the space between the rod and the bottom of the hole, respectively, means for forming a third fluid seal across the proximal end portion of the bore in spaced relationship to the first fluid seal therein, means operative to form a fluid connection between the portion of the bore in the space between the first and third fluid seals and a portion of the hole lying in the gap between the second fluid seal and the bottom of the hole, means for filling the interconnected portions of the bore and the hole with a fluid charge, means external of the charge for applying pressure to the same while the wall of the hole in the gap is exposed to the fluid of the charge, and means for monitoring conditions in the charge to determine the character of the ground surrounding the aforesaid portion of the hole in the gap.

16. Apparatus for fluid pressurizing a portion of the wall of a hole in the ground, comprising an elongated rod adapted to be installed lengthwise in the hole in spaced relationship to the bottom thereof and having a hollow bore therethrough which is open ended at the proximal and distal ends thereof, means defining a plurality of inflatable closure members which are tandemly insertable into the bore of the rod through the proximal end opening thereof and the relatively forward of which is or are adapted to be inserted then into the hole through the distal end opening of the rod for positioning in the space between the rod and the bottom of the hole at a point adapted to leave a gap between one of said members and the bottom of the hole, means for inflating the respective closure members to form first and second fluid seals across the bore of the rod and that portion of the hole in the space between the rod and the bottom of the hole, respectively, means for forming a third fluid seal across the proximal end portion of the bore in spaced relationship to the first fluid seal therein, means operative to form a fluid connection between the portion of the bore in the space between the first and third fluid seals and a portion of the hole lying in the gap between the second fluid seal and a bottom of the hole, means for filling the interconnected portions of the bore and the hole with a fluid charge, and means external of the charge for applying pressure to the same while the wall of the hole in the gap is exposed to the fluid of the charge, the distal end opening of the rod being defined by an annular bit so that the rod can be installed in the hole by excavating the same with the rod in a drilling operation.

17. Apparatus for fluid pressurizing a portion of the wall of a hole in the ground, comprising an elongated rod adapted to be installed lengthwise in the hole in spaced relationship to the bottom thereof and having a hollow bore therethrough which is open ended at the proximal and distal ends thereof, means defining a plurality of inflatable closure members which are tandemly insertable into the bore of the rod through the proximal end opening thereof and the relatively forward of which is or are adapted to be inserted then into the hole through the distal end opening of the rod for positioning in the space between the rod and the bottom of the hole at a point adapted to leave a gap between one of said members and the bottom of the hole, means for inflating the respective closure members to form first and second fluid seals across the bore of the rod and that portion of the hole in the space between the rod and the bottom of the hole, respectively, means for forming a third fluid seal across the proximal end portion of the bore in spaced relationship to the first fluid seal therein, means operative to form a fluid connection between the portion of the bore in the space between the first and third fluid seals and a portion of the hole lying in the gap between the second fluid seal and the bottom of the hole, means for filling the interconnected portions of the bore and the hole with a fluid charge, means external of the charge for applying pressure to the same while the wall of the hole in the gap is exposed to the fluid of the charge, and means for interconnecting, inserting and positioning the array of closure members in the bore and the hole, respectively, including a wireline device by which the array can be lowered into a hole relatively downwardly inclined to the surface of the ground.

18. The apparatus according to claim 17 wherein the means for forming the third fluid seal include a closure device on the wireline device which is engagable with the proximal end portion of the rod to form the third fluid seal across the proximal end portion of the bore therein.

19. The apparatus according to claim 18 wherein the closure device is engagable with the proximal end portion of the rod to form the third fluid seal in spaced relationship to the proximal end of the rod, and there is an inlet on the closure device in the space between the third fluid seal and the proximal end of the rod through which the fluid can be introduced to that portion of the bore in the space between the first and third fluid seals.

20. The apparatus according to claim 17 wherein the wireline device has a tubular fluid transmission member on the bottom thereof and the closure members are carried on the same.

21. A method of fluid pressurizing a portion of the wall of a hole in the ground, comprising installing lengthwise in the hole in spaced relationship to the bottom thereof, an elongated rod having a hollow bore therethrough which is open ended at the proximal and distal ends thereof, inserting into the bore of the rod through the proximal end opening thereof, a plurality of inflatable closure members in tandem array on an elongated support extending from a point outside the bore of the rod adjacent the proximal end opening thereof, and then inserting the relatively forward of said members into the hole through the distal end opening of the rod and positioning the same in the space between the rod and the bottom of the hole so as to leave a gap between one of said members and the bottom of the hole, inflating the respective closure members to form first and second fluid seals across the bore of the rod and that portion of the hole in the space between the rod and the bottom of the hole, respectively, forming a third fluid seal across the proximal end portion of the bore in spaced relationship to the first fluid seal therein, forming a fluid connection between the portion of the bore in the space between the first and third fluid seals and a portion of the hole lying in the gap between the second fluid seal and the bottom of the hole, charging fluid into the aforesaid portion of the bore at a point external of the support and filling the interconnected portions of the bore and the hole with the charge, and applying pressure to the charge by means external thereof while exposing the wall of the hole in the gap to the fluid thereof.

22. The method according to claim 21 wherein the hole is relatively downwardly inclined to the surface of the ground and the inflatable closure members are lowered into the bore of the rod on a wireline device.

23. The method according to claim 21 wherein the inflatable closure members are interconnected in tandem array and have a passage therethrough which extends from one of the remotely oppositely disposed sides of the first and second fluid seals to the other to form the fluid connection between the interconnected portions of the bore of the hole.

24. The method according to claim 21 further comprising removing the third fluid seal from the proximal end portion of the bore after a period of fluid pressurization of the wall of the hole in the gap, and deflating and retracting the inflatable closure members from the hole and the bore through the proximal end opening thereof.

25. The method according to claim 21 wherein the external pressurization means are used to fill the aforesaid portions of the bore and the hole.

26. Apparatus for fluid pressurizing a portion of the wall of a hole in the ground having an elongated rod installed lengthwise therein in spaced relationship to the bottom thereof, said rod having a hollow bore therethrough which is open ended at the proximal and distal ends thereof, comprising means defining a plurality of inflatable closure members on a support adapted so that the members are tandemly insertable in the bore of the rod through the proximal end opening thereof and supportable in the bore from a point outside the same adjacent said proximal end opening, and the relatively forward of which members is or are then insertable into the hole through the distal end opening of the rod for positioning in the space between the rod and the bottom of the hole at a point adapted to leave a gap between one of said members and the bottom of the hole, means for inflating the respective members to form first and second fluid seals across the bore of the rod and that portion of the hole in the space between the rod and the bottom of the hole, respectively, means for forming a third fluid seal across the proximal end portion of the bore in spaced relationship to the first fluid seal therein, means operative to form a fluid connection between the portion of the bore in the space between the first and third fluid seals and a portion of the hole lying in the gap between the second fluid seal and the bottom of the hole, means for charging fluid into the aforesaid portion of the bore at a point external of the support and filling the interconnected portions of the bore and the hole with the charge, and means external of the charge for applying pressure to the same while the wall of the hole in the gap is exposed to the fluid of the charge.

27. The apparatus according to claim 26 wherein the inflatable closure members are assembled in a tandemly spaced array of the same and suspended on a wireline device for lowering into the bore of the rod when the hole is relatively downwardly inclined to the surface of the ground.

28. The apparatus according to claim 26 further comprising means for retaining the relatively rearward of the closure members in the bore of the rod when the relatively forward of the same enters or enter the hole through the distal end opening of the rod, and means for positioning the latter member or members in the space between the rod and the bottom of the hole when the same have entered the hole through the distal end opening of the rod.

29. The apparatus according to claim 28 further comprising means for deflating and retracting the inflatable closure members from the hole and the rod through the proximal end opening thereof.

30. The apparatus according to claim 29 wherein the inflatable closure members are assembled in a tandemly spaced array of the same and suspended on a wireline device for lowering into the bore of the rod when the hole is relatively downwardly inclined to the surface of the ground.

31. The apparatus according to claim 26 wherein the inflatable closure members are interconnected in tandem array and have a passage therethrough which is adapted to extend from one of the remotely oppositely disposed sides of the first and second fluid seals to the other to form the fluid connection between the portions of the bore and the hole.

32. The apparatus according to claim 26 wherein the external pressurization means are adapted to fill the interconnected portions of the bore and the hole with the fluid charge.

33. Apparatus for fluid pressurizing a portion of the wall of a hole in the ground, comprising an elongated rod adapted to be installed lengthwise in the hole in spaced relationship to the bottom thereof and having a hollow bore therethrough which is open ended at the proximal and distal ends thereof, means defining a plurality of inflatable closure members on a support adapted so that the members are tandemly insertable in the bore of the rod through the proximal end opening thereof and supportable in the bore from a point outside the same adjacent to said proximal end opening, and the relatively forward of which members is or are then insertable into the hole through the distal end opening of the rod for positioning in the space between the rod and the bottom of the hole at a point adapted to leave a gap between one of said members and the bottom of the hole, means for inflating the respective members to form first and second fluid seals across the bore of the rod and that portion of the hole in the space between the rod and the bottom of the hole, respectively, means for forming a third fluid seal across the proximal end portion of the bore in spaced relationship to the first fluid seal therein, means operative to form a fluid connection between the portion of the bore in the space between the first and third fluid seals and a portion of the hole lying in the gap between the second fluid seal and the bottom of the hole, means for charging fluid into the aforesaid portion of the bore at a point external of the support and filling the interconnected portions of the bore and the hole with the charge, and means external of the charge for applying pressure to the same while the wall of the hole in the gap is exposed to the fluid of the charge.

34. The apparatus according to claim 33 wherein the inflatable closure members are assembled in a tandemly spaced array of the same and suspended on a wireline device for lowering into the bore of the rod when the hole is relatively downwardly inclined to the surface of the ground.

35. The apparatus according to claim 33 wherein the support includes means for interconnecting the closure members in spaced tandem array and inserting and positioning the same in the bore and the hole, respectively.

36. The apparatus according to claim 35 wherein the inflatable closure members have a passage therein which is adapted to extend through the same between the remotely oppositely disposed sides of the first and second fluid seals to interconnect that portion of the bore in the space between the first and third fluid seals with that portion of the hole in the gap between the second fluid seal and the bottom of the hole.

* * * * *